US005563474A

United States Patent [19]

Wessels et al.

[11] Patent Number: 5,563,474

[45] Date of Patent: Oct. 8, 1996

[54] ELECTRODELESS LOW-PRESSURE DISCHARGE LAMP

[75] Inventors: Johannes H. Wessels; Jeroen P. Balm, both of Eindhoven, Netherlands; Jacob Schlejen, Morgantown, W. Va.; Petrus H. Antonis, Eindhoven, Netherlands

[73] Assignee: U.S. Philips Corporation, New York, N.Y.

[21] Appl. No.: 515,105

[22] Filed: Aug. 14, 1995

Related U.S. Application Data

[63] Continuation of Ser. No. 173,439, Dec. 23, 1993, abandoned.

[30] Foreign Application Priority Data

Dec. 23, 1992 [EP] European Pat. Off. ..... 92204066

[51] Int. Cl.[6] ..... H05B 41/16

[52] U.S. Cl. ..... 315/248; 315/150

[58] Field of Search ..... 315/248, 267, 315/150, 344; 313/635

[56] References Cited

U.S. PATENT DOCUMENTS

| | | | |
|---|---|---|---|
| 3,997,816 | 12/1976 | Haugsjaa et al. | 315/267 |
| 4,185,228 | 1/1980 | Regan | 315/150 |
| 4,247,800 | 1/1981 | Proud et al. | 315/248 |
| 4,555,648 | 11/1985 | Iida et al. | 315/150 |
| 4,652,790 | 3/1987 | Wood | 315/150 |
| 4,987,344 | 1/1991 | Zaslavsky et al. | 315/150 |
| 5,148,085 | 9/1992 | Kroes | 315/248 |
| 5,323,091 | 6/1994 | Morris | 315/248 |
| 5,336,971 | 8/1994 | Vermeulen et al. | 315/248 |

FOREIGN PATENT DOCUMENTS

| | | | |
|---|---|---|---|
| 0162504 | 11/1985 | European Pat. Off. | H01J 65/04 |
| 0317179 | 5/1989 | European Pat. Off. . | |
| 0216230 | 9/1986 | Japan | 315/150 |

*Primary Examiner*—Robert Pascal
*Assistant Examiner*—Darius Gambino
*Attorney, Agent, or Firm*—Brian J. Wieghaus

[57] ABSTRACT

An electrodeless low-pressure discharge lamp includes a translucent discharge-vessel of a glass that contains at least 5 weight % sodium, encloses a discharge-space and includes a mercury containing fill. The lamp further includes a device to maintain an electrical discharge in the discharge space and an auxiliary radiation source that emits at least 0.5 mW of visible radiation when activated, to provide a relatively short ignition time.

27 Claims, 2 Drawing Sheets

ELECTRODELESS LOW-PRESSURE DISCHARGE LAMP

This is a continuation of application Ser. No. 08/173,439, filed Dec. 23, 1993 and now abandoned.

BACKGROUND OF THE INVENTION

The invention relates to an electrodeless low-pressure discharge lamp provided with a light-transmitting discharge vessel which encloses a discharge space in a gastight manner and which is made of a glass comprising at least 5% by weight of sodium oxide and has a filling comprising mercury, which lamp is in addition provided with means for maintaining an electric discharge in the discharge space.

An electrodeless low-pressure discharge lamp, also referred to in the present description and claims as "lamp", is understood to be a low-pressure discharge lamp in which the discharge is maintained by means other than electrodes situated inside the discharge vessel. The means for maintaining the discharge may comprise, for example, a microwave generator. Electrodes may be present for different purposes. For example, one or several, for example external electrodes may be present for promoting lamp ignition. Lamps of the kind described in the opening paragraph may have a comparatively long life owing to the absence of electrodes which are permanently loaded during nominal operation compared with lamps which do have electrodes.

An electrodeless low-pressure discharge lamp of the kind described in the opening paragraph is known from EP 0 162 504. The discharge vessel of the known lamp is made partly from lime glass and partly from lead glass. These glasses are easy to process and have the advantage that they substantially do not transmit UV-C radiation (<280 nm) which is detrimental to human health. Mercury resonance radiation generated in the discharge space of the lamp cannot reach the surroundings of the lamp as a result. In the known lamp, the means for maintaining the discharge comprise a first and a second winding of an electric conductor around a core of magnetic material. To ignite the known lamp, an ignition voltage is applied across the first winding, which voltage is comparatively high compared with the voltages across this winding during nominal operation. The supply device is comparatively heavily loaded during this.

The known lamp has the disadvantage that the ignition time, i.e. the time interval between the moment at which an ignition voltage is offered and the moment when a discharge comes into being, is comparatively long, especially when the lamp has been out of action for a few days. As a result, special measures are necessary for avoiding the life of the supply device from being adversely affected.

SUMMARY OF THE INVENTION

It is an object of the invention to provide an electrodeless low-pressure discharge lamp of the kind mentioned in the opening paragraph which ignites comparatively easily.

The electrodeless low-pressure discharge lamp according to the invention is for this purpose characterized in that the lamp is further provided with an auxiliary radiation source which in the activated state generates visible radiation with a power of at least 0.5 mW. The auxiliary radiation source which generates visible radiation with a power of at least 0.5 mW gives the lamp a comparatively short ignition time. No significant improvement in the ignition behaviour occurs at lower powers. The power of the generated radiation preferably is not greater than approximately 150 mW. At comparatively high powers, for example, above 500 mW, a comparatively high power is required for supplying the auxiliary radiation source while no significant further improvement in the ignition behaviour of the lamp occurs.

It is suspected that the visible radiation generated by the auxiliary radiation source promotes the ionization of sodium atoms at the surface of the discharge vessel facing the discharge space, as a result of which free electrons become available for initiating a discharge.

It is noted that U.S. Pat. No. 3,997,816 discloses an electrodeless low-pressure gas discharge lamp whose discharge vessel is provided with a tilting comprising mercury and which has an auxiliary radiation source for promoting lamp ignition. In the known lamp, however, the discharge vessel is made of quartz glass and the auxiliary radiation source is a UV radiation source. Quartz glass, which contains at least substantially no sodium, largely transmits UV radiation, so that the high-energy UV radiation of the auxiliary radiation source can easily reach the discharge space.

In an embodiment of the lamp according to the invention, the auxiliary radiation source comprises one or several incandescent lamps. It is attractive when the auxiliary radiation source is generating radiation already when an ignition voltage is offered to the means for maintaining the discharge, or does so shortly afterwards, for example, within a few ms. This may be realised, for example, in that the auxiliary radiation source is connected to separate terminals of a supply device, at which terminals a supply voltage for the auxiliary radiation source is available already before an ignition voltage is provided. The ignition time of the lamp is then at least substantially not prolonged by the period which the auxiliary radiation source requires for becoming active. In an advantageous embodiment of the lamp according to the invention, the auxiliary radiation source comprises at least a discharge lamp which is provided with at least an internal electrode. Such an auxiliary radiation source, for example a spark bridge, can emit light very quickly after a supply voltage is offered. Separate terminals for connecting the auxiliary radiation source, with the object of preventing a delay in lamp ignition, are unnecessary then.

The discharge lamp which forms the auxiliary radiation source or forms part thereof may be, for example, a glow lamp. The inventors have found that, with the use of a glow lamp as the auxiliary radiation source, the lamp still ignites easily also after having been out of action for some tens of hours. An electrodeless low-pressure discharge lamp according to this embodiment is very suitable, for example, for illumination of roads, where the lamp is ignited every day after daylight has faded.

In some applications, for example the illumination of infrequently used warehouses, it may happen that the lamp is out of action for several weeks in a dark room. In an advantageous embodiment of the lamp according to the invention, the discharge lamp which forms the auxiliary radiation source, or forms part thereof, is a flashbulb. A lamp according to this embodiment of the invention ignites readily also under these circumstances.

The auxiliary radiation source may have a comparatively long active life in some implementations. Glow lamps, for example, can be operated for some tens of thousands of burning hours. In a favourable embodiment of the lamp according to the invention, the auxiliary radiation source is inactive during nominal operation of the lamp. In this embodiment, the risk of failure of the auxiliary radiation source is small also after a comparatively long total period of use of the lamp, even when an auxiliary radiation source having a comparatively short active life is used. When an auxiliary radiation source is used whose luminous flux decreases with its operational life, this measure has the advantage that the luminous decrement of the auxiliary radiation source is comparatively small, also after a comparatively long total period of use of the lamp.

In some applications it is desirable to reduce the luminous flux of the lamp, for example, to 15% of the rated luminous flux. According to a known method of operation, this is realised by means of a supply device which periodically extinguishes and re-ignites the lamp, for example, with a frequency of approximately 400 Hz. This method of operation has the advantage that the intensity of the fight generated by the lamp can be reduced without other photometric properties, such as the colour point, being substantially changed. The voltages applied to the means for maintaining the discharge are comparatively high in this method of operation in order to re-ignite the lamp every cycle. Preferably, the auxiliary radiation source also remains inactive during this so that the risk of failure of the auxiliary radiation source is small also under these circumstances, also after a comparatively long total period of use of the lamp, even if an auxiliary radiation source with a comparatively short active life is used. For reasons mentioned above, this measure can also favourably affect the luminous flux gradient of the auxiliary radiation source throughout the period of use of the lamp. The auxiliary radiation source may be connected, for example, to separate terminals of a supply device, which terminals carry no voltage during nominal operation and, if so desired, also during reduced operation of the lamp.

In a further attractive embodiment of the lamp according to the invention, the auxiliary radiation source is included in a circuit which is connected in parallel to the means for maintaining the discharge. In this embodiment, separate connection terminals for the auxiliary radiation source are unnecessary. A discharge lamp as the auxiliary radiation source will extinguish below a predetermined voltage. In this embodiment of the lamp, this has the advantage that it can be achieved by a simple measure that the auxiliary radiation source is inactive during nominal operation and, if so desired, also during reduced operation of the lamp. Alternatively, for example, the auxiliary radiation source may comprise a series arrangement of light-emitting diodes with a total luminous flux of, for example, 2 mW, in series with a breakdown element, for example an electronic breakdown element such as a DIAC, which cuts off the circuit after a nominal operating state has been reached.

The auxiliary radiation source is accommodated, for example, in the atmosphere of the discharge vessel, but it may alternatively be arranged outside the atmosphere of the discharge vessel, for example, in a recessed portion of the discharge vessel. An attractive embodiment of the electrodeless low-pressure discharge lamp according to the invention which is easy to assemble is characterized in that the auxiliary radiation source is arranged in a carrier which is connected to the discharge vessel. The carrier may have a lamp cap, for example, at an end remote from the discharge vessel, which cap is provided with electrical contacts connected to a supply device for the lamp, which device is accommodated in the carrier.

BRIEF DESCRIPTION OF THE DRAWINGS

Embodiments of the electrodeless low-pressure discharge lamp according to the invention are explained in more detail in the ensuing description with reference to the drawings, in which.

DETAILED DESCRIPTION OF THE PREFERRED EMBODIMENTS

Figure 1:
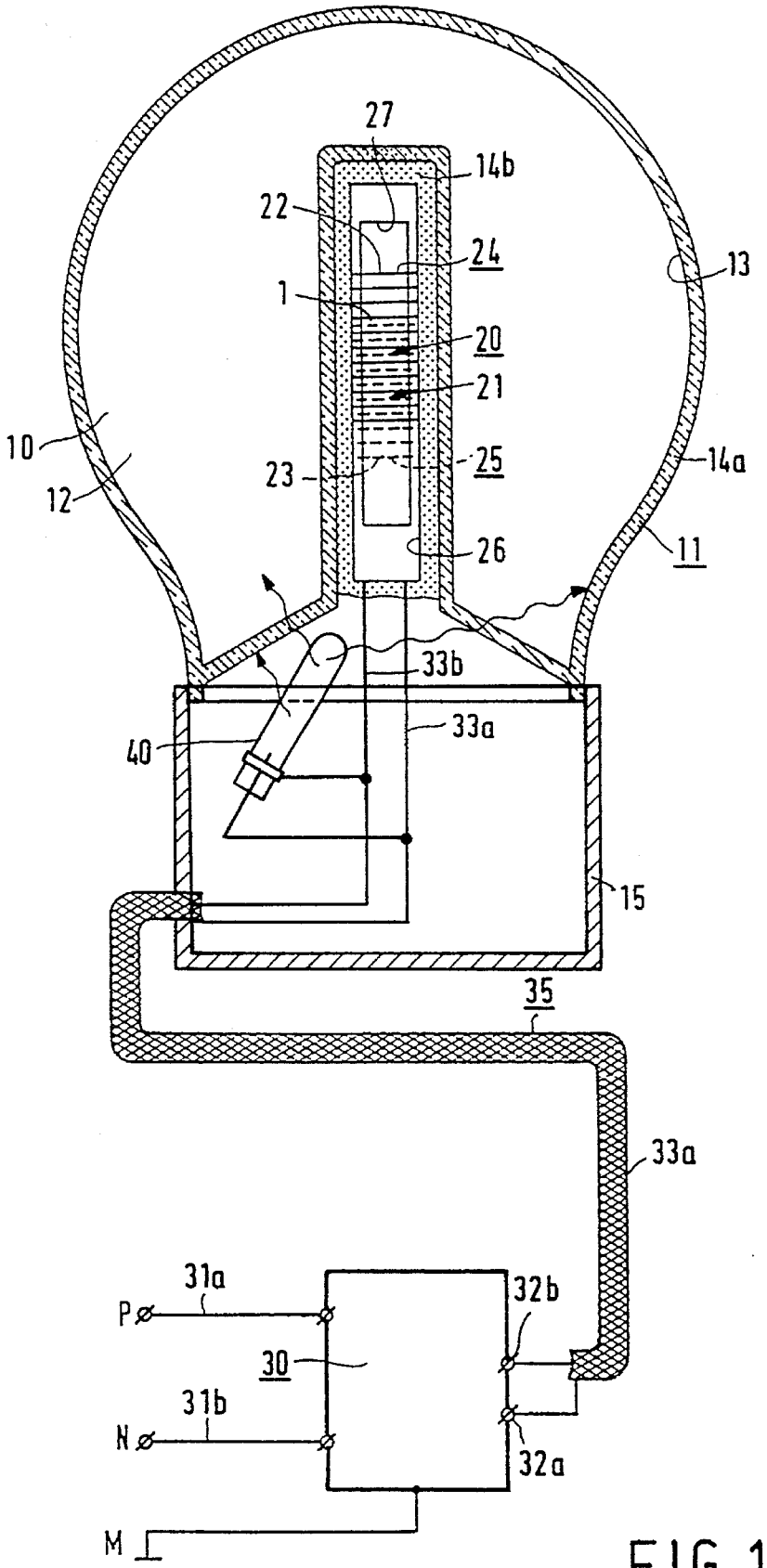
FIG. 1 shows a first embodiment. The electrodeless low-pressure discharge lamp is shown therein partly in elevation and partly in longitudinal section. The Figure also diagrammatically shows a supply device.

The first embodiment of the electrodeless low-pressure discharge lamp according to the invention shown in FIG. 1 is provided with a discharge vessel 11 which encloses a discharge space 10 in a gaslight manner and which has a filling 12 comprising an amalgam of 6 mg mercury and 180 mg of an alloy of bismuth and indium in a weight ratio of 67:33. The filling 12 in addition comprises argon with a filling pressure of 33 Pa. The discharge vessel 11 has a pear-shaped enveloping portion 14*a* and a tubular recessed portion 14*b* of which a tapering end is connected to the enveloping portion 14*a*. The enveloping portion 14*a* of the discharge vessel 11 is made of lime glass with a composition by weight of 64.1% $SiO_2$, 17.3% $Na_2O$, 5.2% BaO, 4.8% $Al_2O_3$, 4.8% CaO, 3.1% MgO, and 0.7% $K_2O$. The recessed portion is made of lead glass. Its composition is 62.9% $SiO_2$, 21.7% PbO, 7.3% BaO, 6.8% $Na_2O$, 1.3% $Al_2O_3$. The discharge vessel 11 is provided at an inner surface with a layer 13 of a luminescent material which comprises green-luminescing terbium-activated cerium-magnesium aluminate and red-luminescing yttrium oxide activated by trivalent europium. The means 20 for maintaining an electric discharge in the discharge vessel 11 are formed by a coil 21 accommodated in the recessed portion 14*b* of the discharge vessel. The coil 21 shown in elevation has fifteen turns 22 of a primary winding 24 and also fifteen turns 23 of a secondary winding 25 around a coil former 26 made of synthetic material surrounding a core 27 of soft-magnetic material. For reasons of clarity, only a portion of the turns of each winding is indicated in FIG. 1, and the coil former 26 is shown as transparent. In this embodiment, the core 27 is a rod of Philips 4C6 ferrite with a diameter of 12 mm and a length of 50 mm. The turns 24, 25 are formed from insulated copper wire with a core thickness of 0.87 mm and extend over a distance of 32 mm around the core 27. Each of the turns 23 of the secondary winding 25 lies against a turn 22 of the primary winding 24. The means 20 are connected to output terminals 32*a*, 32*b* of a supply device 30 via current supply conductors 33*a*, 33*b*. The current supply conductors 33*a*, 33*b* form a sheath and a core, respectively, of a coax cable 35 over part of their length. The output terminal 32*a* is electrically substantially neutral relative to mass M. The supply device 30 in addition has input terminals 31*a*, 31*b*.

The lamp according to the invention is further provided with an auxiliary radiation source 40 shown in elevation in the Figure, which in the activated state generates visible radiation with a power of at least 0.5 mW.

In this case the discharge lamp forming the auxiliary radiation source 40 is a xenon flashbulb which generates visible radiation with a power of approximately 10 mW when an ignition voltage of approximately 1000 V is offered by the means 20.

The auxiliary radiation source 40 is arranged in a carrier or housing 15 connected to the discharge vessel 11.

Figure 2:
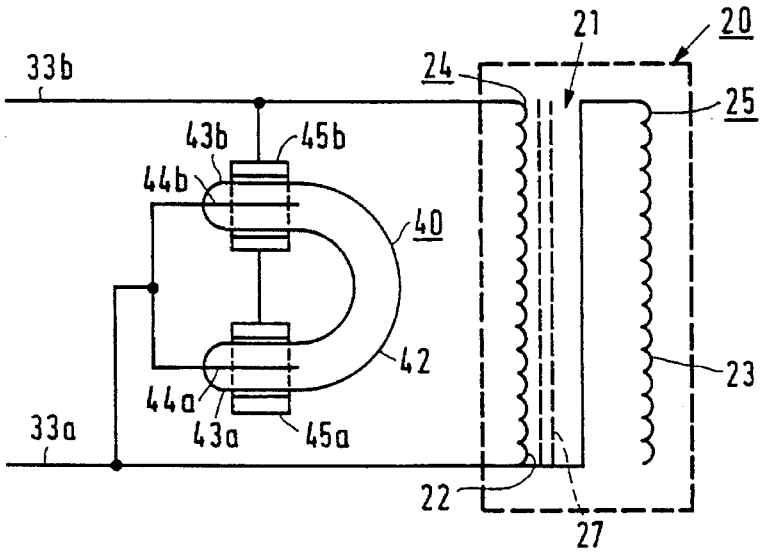
FIG. 2 shows for this embodiment the circuit comprising the auxiliary radiation source and the means for maintaining the discharge.

The xenon flashbulb, which is shown in more detail in FIG. 2, is a discharge lamp constructed as a U-shaped tube 42 and provided with an internal electrode 44*a*. The internal electrode 44*a* and a further internal electrode 44*b* are arranged at respective ends 43*a*, 43*b* of the tube 42. The xenon flashbulb shown also has mutually interconnected external electrodes 45*a*, 45*b* which each surround a portion of the tube 42 surrounding a respective internal electrode 44*a*, 44*b*. The xenon flashbulb is of the FT-50 type from the Display Catalogue 91/92, page 4/75.

The auxiliary radiation source 40 is included in a circuit in parallel to the means 20 in that the external electrodes 45*a*, 45*b* are connected to current supply conductor 33*b* and the internal electrodes 44*a*, 44*b* are connected to current supply conductor 33*a*. Since one of the current supply conductors, 33*b*, is connected to the external electrodes 45*a*, 45*b*, whereby a capacitor is formed by the external electrodes 45*a*, 45*b*, the discharge space of the flashbulb and the wall of the flashbulb, a separate component for limiting the current through the flashbulb is redundant.

Figure 3:
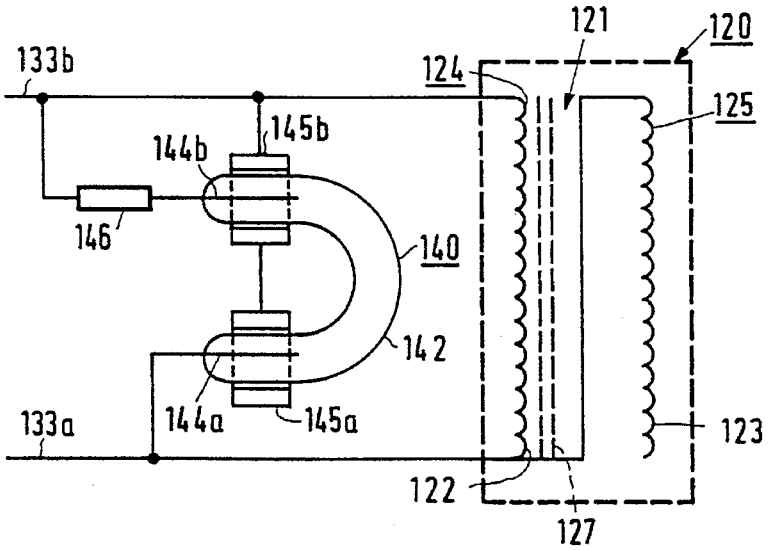
FIGS. 3 and 4 show such circuits belonging to a second and a third embodiment, respectively.

In FIG. 3, components corresponding to those of FIG. 2 have reference numerals which are 100 higher. In the embodiment shown in FIG. 3, the first internal electrode 144*a* is connected to the current supply conductor 133*a*, and the second internal electrode 144*b* is connected to the current supply conductor 133*b* via a 10 kΩ resistor which forms a series impedance 146. Alternatively, the series impedance 146 in this embodiment may be a capacitor, for example, one having a capacitance of 6 to 10 pF. It was found that the flashbulb extinguishes both during nominal operation and during reduced operation of the electrodeless low-pressure discharge lamp.

Figure 4:
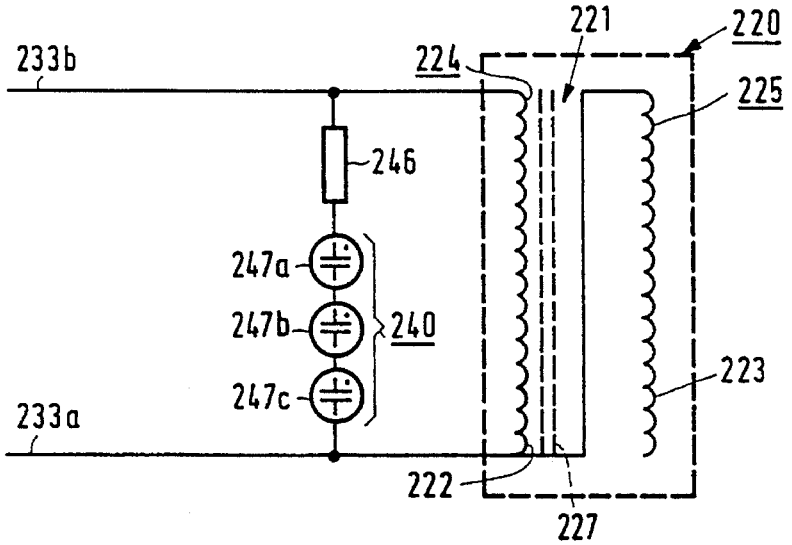

In FIG. 4, components corresponding to those of FIG. 2 have reference numerals which are 200 higher. In the embodiment shown therein, the auxiliary radiation source 240 is formed by glow lamps 247*a*, 247*b*, 247*c* which are connected in series mutually and with a series impedance 246. The Table given below contains data of practical implementations of this embodiment in rows 2 to 8. The first row shows data of a lamp not according to the invention in which an auxiliary radiation source is absent, but which corresponds to the lamp according to the invention in all other respects. In the Table, the first column gives the type and number of glow lamps 447*a*, 447*b*, 447*c*. The indications GL4, GL10 and GL11 therein are the glow lamps listed on pp. 110 and 111 in the "Philips Compact Lighting Catalogue 1990/91". The second column contains the values of the series resistors 246 used ($R_{ser}$ in kΩi).

Of the said lamps, eight pcs. of each type, the average value of the ignition time ($T_{ign}$ in ms) was determined as well as the number of lamps having an ignition time in excess of 40 ms ($N_{T>40\ ms}$) after the lamps had been inoperative for approximately 20 hours and had been subsequently arranged in a darkened room for five minutes before an ignition voltage was offered at the means for maintaining the discharge. The ignition voltage offered by the supply device was 1000 V. In addition, the power of the visible radiation generated by the auxiliary radiation source ($P_t$ in mW) in the case of the lamps according to the invention. The extinction voltage ($V_d$ in V) was measured for a few circuits.

| Aux. Radiation source | $R_{ser}$(kΩ) | $P_{st}$(mW) | $T_{ign}$(ms) | $N_{T>40\ ms}$ | $V_d$ |
|---|---|---|---|---|---|
| — | — | — | 216.9 | 5 | — |
| 3xGL11 | 27 | 16 | 1.61 | 0 | 400 |
| 3xGL11 | 39 | 9.3 | 1.13 | 0 | 420 |
| 3xGL4 | 100 | 1.9 | 2.37 | 0 | — |
| 3xGL10 | 100 | 1.5 | 1.09 | 0 | — |
| 3xGL11 | 56 | 5.3 | 0.98 | 0 | 450 |
| 2xGL11 + 1xGL10 | 56 | 4 | 0.94 | 0 | 200 |
| 2xGL11 + 1xGL10 | 27 | 13.3 | 2.7 | 0 | — |

Five of the lamps not according to the invention fail to ignite within 40

Five of the lamps not according to the invention fail to ignite within 40 ms. All lamps according to the invention had an ignition time below 40 ms. An ignition pulse of 1000 V is easy to realise for approximately 40 ms in practice. The total load to which the supply device is subjected as a result of the ignition voltage offered is then restricted to an acceptable level.

The auxiliary radiation source is inactive during nominal operation in all embodiments listed in the Table.

Among the embodiments listed in the Table, the circuit provided with three glow lamps of the G11 type in series with a 39 kΩ resistor and that comprising a 56 kΩ resistor have the advantage that they are particularly suitable for a reduced lamp operation mode as described above because the auxiliary radiation source is inactive also under these circumstances.

Sixty lamps of the embodiment shown in FIGS. 1 and 2 were stored in closed boxes impermeable to light for eight weeks without being operated and subsequently made to ignite at a voltage of 1000 V. Only two of these lamps (3.3%) had an ignition time of more than 40 ms. Of lamps not according to the invention, in which an auxiliary radiation source is absent, the ignition time after 40 hours or longer under the said conditions without being operated was longer than 40 ms in six out of the ten cases (60%).

We claim:

1. An electrodeless low-pressure discharge lamp, comprising:

a light-transmitting discharge vessel which encloses a discharge space in a gastight manner, said discharge vessel comprising a glass having at least 5% by weight of sodium oxide, said discharge vessel being free of electrodes within said discharge space;

a discharge sustaining filling within said discharge vessel;

means for maintaining an electric discharge in the discharge space; and an auxiliary radiation source which in the activated state generates visible radiation with a power of at least 0.5 mW.

2. An electrodeless low-pressure discharge lamp as claimed in claim 1, characterized in that the auxiliary radiation source comprises an auxiliary discharge lamp having an internal electrode.

3. An electrodeless low-pressure discharge lamp as claimed in claim 2, characterized in that the auxiliary discharge lamp is a glow lamp.

4. An electrodeless low-pressure discharge lamp as claimed in claim 2, characterized in that the auxiliary discharge lamp is a flashbulb.

5. An electrodeless low-pressure discharge lamp as claimed in claim 4, characterized in that the auxiliary radiation source is inactive during nominal operation of the lamp.

6. An electrodeless low-pressure discharge lamp as claimed in claim 5, characterized in that the auxiliary radiation source is inactive during reduced operation of the lamp.

7. An electrodeless low-pressure discharge lamp as claimed in claim 6, characterized in that the auxiliary radiation source is connected electrically in parallel to the means for maintaining the discharge.

8. An electrodeless low-pressure discharge lamp as claimed in claim 6, further comprising a carrier connected to the discharge vessel and enclosing the auxiliary radiation source.

9. An electrodeless low-pressure discharge lamp as claimed in claim 1, characterized in that the auxiliary radiation source is inactive during nominal operation of the lamp.

10. An electrodeless low-pressure discharge lamp as claimed in claim 1, characterized in that the auxiliary radiation source is connected electrically in parallel to the means for maintaining the discharge.

11. An electrodeless low-pressure discharge lamp as claimed in claim 1, further comprising a carrier connected to the discharge vessel and enclosing the auxiliary radiation source.

12. An electrodeless low-pressure discharge lamp as claimed in claim 2, characterized in that the auxiliary radiation source is inactive during nominal operation of the lamp.

13. An electrodeless low-pressure discharge lamp as claimed in claim 2, characterized in that the auxiliary radiation source is connected electrically in parallel to the means for maintaining the discharge.

14. An electrodeless low-pressure discharge lamp as claimed in claim 2, further comprising a carrier connected to the discharge vessel and enclosing the auxiliary radiation source.

15. An electrodeless low-pressure discharge lamp as claimed in claim 3, characterized in that the auxiliary radiation source is inactive during nominal operation of the lamp.

16. An electrodeless low-pressure discharge lamp as claimed in claim 3, characterized in that the auxiliary radiation source is connected electrically in parallel to the means for maintaining the discharge.

17. An electrodeless low-pressure discharge lamp as claimed in claim 3, further comprising a carrier connected to the discharge vessel and enclosing the auxiliary radiation source.

18. An electrodeless low-pressure discharge lamp as claimed in claim 4, characterized in that the auxiliary radiation source connected electrically in parallel to the means for maintaining the discharge.

19. An electrodeless low-pressure discharge lamp as claimed in claim 4, further comprising a carrier connected to the discharge vessel and enclosing the auxiliary radiation source.

20. An electrodeless low-pressure discharge lamp as claimed in claim 5, characterized in that the auxiliary radiation source connected electrically in parallel to the means for maintaining the discharge.

21. An electrodeless low-pressure discharge lamp as claimed in claim 9, characterized in that the auxiliary radiation source is inactive during reduced operation of the lamp.

22. An electrodeless low pressure discharge lamp according to claim 1, wherein said discharge sustaining filling comprises mercury.

23. An electrodeless low pressure discharge lamp, comprising:

a discharge vessel sealed in a gas tight manner and enclosing a discharge space, said discharge vessel comprising a glass portion having at least 5% by weight of sodium oxide and being substantially non-transmissive to UV-C radiation, said discharge vessel being free of electrodes within said discharge space;

a discharge sustaining filling within said discharge vessel;

means for maintaining a discharge in said discharge space; and an ignition aid for inducing ignition of said discharge, said ignition aid comprising a radiation source adjacent to said sodium oxide containing glass portion, which radiation source generates visible radiation with a power of at least 0.5 mW.

24. An electrodeless low pressure discharge lamp, comprising:

a discharge vessel sealed in a gas-tight manner and enclosing a discharge space, said discharge vessel having a portion with an inner surface communicating with the discharge space and consisting of a glass having at least 5% by weight of sodium oxide, said discharge vessel being free of electrodes within said discharge space;

a discharge sustaining filling within said discharge vessel;

means for maintaining a discharge in said discharge space; and an ignition aid for inducing ignition of said discharge, said ignition aid comprising a radiation source which generates visible radiation with a power of at least 0.5 mW for promoting the ionization of sodium atoms at said inner surface portion having at least 5% by weight of sodium oxide.

25. A gas discharge lamp, comprising:

a discharge device in which a gas discharge is maintained during nominal operation, said discharge device comprising a discharge vessel sealed in a gas-tight manner and enclosing a discharge space and a discharge sustaining filling within said discharge space, said discharge vessel being free of electrodes within said discharge space; and ignition means for inducing ignition of a discharge within the discharge device, the ignition means comprising (i) said discharge vessel having a portion which is transmissive to visible light and which portion has an inner surface communicating with said discharge space, said inner surface comprising a glass comprised of a material which is ionizable when exposed to visible light and (ii) a source of visible radiation in view of said discharge vessel portion which emits visible light with sufficient intensity to ionize said material of said glass at said inner surface to introduce free electrons into said discharge space to thereby distinctly improve the ignition characteristics of said lamp.

26. A gas discharge lamp according to claim 24, wherein said material of said glass is sodium oxide.

27. A gas discharge lamp according to claim 25, wherein said source of visible radiation radiates visible light with a power of at least 50 mW.

* * * * *